US012557896B2

(12) United States Patent
Bickford et al.

(10) Patent No.: US 12,557,896 B2
(45) Date of Patent: Feb. 24, 2026

(54) COSMETIC APPLICATOR WITH FLEXIBLE APPLICATOR TIP

(71) Applicant: L'OREAL, Paris (FR)

(72) Inventors: William Robert Bickford, Scotch Plains, NJ (US); Simon Nicholas Dutton, Basking Ridge, NJ (US)

(73) Assignee: L'Oreal, Paris (FR)

( * ) Notice: Subject to any disclaimer, the term of this patent is extended or adjusted under 35 U.S.C. 154(b) by 72 days.

(21) Appl. No.: 17/409,391

(22) Filed: Aug. 23, 2021

(65) Prior Publication Data

US 2022/0061497 A1 Mar. 3, 2022

Related U.S. Application Data

(60) Provisional application No. 63/071,758, filed on Aug. 28, 2020.

(30) Foreign Application Priority Data

Oct. 22, 2020 (FR) ..... 2010831

(51) Int. Cl.
*A45D 34/04* (2006.01)
*A46B 9/00* (2006.01)

(52) U.S. Cl.
CPC ..... *A45D 34/042* (2013.01); *A46B 9/005* (2013.01); *A45D 2200/1018* (2013.01); *A46B 2200/1046* (2013.01)

(58) Field of Classification Search
CPC ..... A45D 2200/1018; A45D 34/042; A45D 34/045; A45D 2040/0012; A45D 40/262; A45D 40/265; A45D 40/28; A45D 2200/1009; A46B 2200/1046; A46B 2200/1053; A46B 11/0041; A46B 9/005
USPC ..... 132/320
See application file for complete search history.

(56) References Cited

U.S. PATENT DOCUMENTS 285,999 A * 10/1883 Hammerl ..... B05C 17/12 15/210.5
450,378 A * 4/1891 Robinson ..... B24D 15/00 451/461
676,966 A * 6/1901 Simmons ..... A47L 25/00 15/210.1
1,214,556 A * 2/1917 Le Vene ..... A46B 5/04 15/104.94

(Continued)

FOREIGN PATENT DOCUMENTS

EP 1 195 103 A1 4/2002
EP 2 329 741 A1 6/2011

(Continued)

OTHER PUBLICATIONS

French Preliminary Search Report issued Jun. 16, 2021 in Patent Application No. FR 2010831 (with English translation of categories of cited documents), 9 pages.

*Primary Examiner* — Thomas C Barrett
*Assistant Examiner* — Holly T. To
(74) *Attorney, Agent, or Firm* — Christensen O'Connor Johnson Kindness PLLC

(57) ABSTRACT

A cosmetic applicator tip includes a base; a primary surface extending from the base, the primary surface including a height, a thickness, and a width; at least one auxiliary wall extending from the base, each auxiliary wall of the at least one auxiliary wall including a height.

6 Claims, 14 Drawing Sheets

(56) References Cited

U.S. PATENT DOCUMENTS 1,405,279 A * 1/1922 Cassedy ..... A46B 9/005 200/84 R
1,473,000 A * 11/1923 Weatherwax ..... A46B 3/005 15/210.1
1,526,267 A * 2/1925 Dessau ..... A46B 9/005 156/227
1,625,863 A * 4/1927 Mclarty ..... E04F 11/16 33/44
1,635,127 A * 7/1927 Kirsner ..... A47L 25/00 15/210.1
1,823,797 A * 9/1931 Finkel ..... A45D 33/34 15/244.4
1,873,030 A * 8/1932 Quinn ..... A45D 33/34 15/229.14
2,099,030 A * 11/1937 Morrison ..... B44D 2/00 132/320
2,132,757 A * 10/1938 Paulson ..... A63H 33/04 446/124
2,147,458 A * 2/1939 Rohland ..... A45D 7/04 15/236.08
2,165,420 A * 7/1939 Seifert ..... A61C 17/00 15/244.4
2,354,969 A * 8/1944 Trindl ..... A47L 13/257 15/147.1
2,476,201 A * 7/1949 Ligoure ..... A46B 9/005 15/207.2
2,557,221 A * 6/1951 Gazda ..... B65D 35/36 401/266
2,604,105 A * 7/1952 Kruck ..... A45D 40/26 132/320
2,637,870 A * 5/1953 Cohen ..... A46B 7/04 15/186
2,842,789 A * 7/1958 Wells ..... A47L 13/12 15/245
2,904,814 A * 9/1959 Scholl ..... A45D 33/34 156/251
2,964,772 A * 12/1960 Crawford ..... A45D 33/00 15/210.1
3,080,687 A * 3/1963 Gross ..... A47L 13/16 15/118
3,142,855 A * 8/1964 Gilchrist ..... A47L 23/10 15/210.1
3,188,672 A * 6/1965 Gary ..... A46B 5/0025 15/201
3,220,040 A * 11/1965 Knaebe ..... A47K 7/028 15/147.1
D214,238 S * 5/1969 Bender ..... D24/152
3,465,377 A * 9/1969 Thomas ..... A47L 13/29 15/147.1
3,472,242 A * 10/1969 Demner ..... A61Q 19/10 D28/8
3,491,396 A * 1/1970 Granieri, Jr. ..... A46B 3/005 15/104.94
3,590,414 A * 7/1971 Gores ..... A47K 7/028 15/207.2
3,611,468 A * 10/1971 Michael ..... A47L 13/16 15/118
3,640,288 A * 2/1972 Spanel ..... A45D 19/028 D28/7
3,707,012 A * 12/1972 Lane ..... A47K 7/03 15/244.4
3,939,522 A * 2/1976 Shimizu ..... A61H 13/00 15/244.1
4,053,242 A * 10/1977 Mast, Jr. ..... A61F 15/001 401/6
4,081,877 A * 4/1978 Vitale ..... A46B 9/005 D24/152
4,083,078 A * 4/1978 Shimizu ..... A61H 13/00 15/244.1
4,149,815 A * 4/1979 Kawam ..... A61K 8/02 15/104.93
4,471,505 A * 9/1984 Spademan ..... A46D 1/00 15/186
D282,698 S * 2/1986 Newton, Jr. ..... D24/119
D282,977 S * 3/1986 Harvey ..... D28/31
4,866,806 A * 9/1989 Bedford ..... A47L 13/16 15/244.4
D312,339 S * 11/1990 Nero, III ..... D32/51
5,062,435 A * 11/1991 Ohtsuka ..... A45D 24/30 132/108
D343,484 S * 1/1994 Moran ..... D32/40
5,312,197 A * 5/1994 Abramson ..... A46B 11/00 401/11
D351,696 S * 10/1994 Adolf ..... D28/63
D354,624 S * 1/1995 Gupta ..... D24/146
5,771,524 A * 6/1998 Woods ..... A45D 40/00 604/385.03
5,806,135 A * 9/1998 Earle ..... A47L 13/16 15/244.4
5,832,832 A * 11/1998 Carsel ..... B44D 3/00 101/406
5,900,068 A * 5/1999 Thomas ..... B32B 5/24 15/209.1
5,913,318 A * 6/1999 Gueret ..... A45D 33/34 132/320
D417,324 S * 11/1999 Farls ..... D32/42
6,026,824 A * 2/2000 Gueret ..... A46B 9/021 132/218
6,041,467 A * 3/2000 Roberts ..... A46B 9/005 132/309
6,205,611 B1 * 3/2001 Vigil ..... A46B 11/0003 206/439
6,276,023 B1 * 8/2001 Grundy ..... A47L 13/34 15/210.1
6,286,518 B1 * 9/2001 Laporte ..... A45D 19/026 132/115
6,312,181 B1 * 11/2001 Joulia ..... A45D 40/28 401/196
6,315,482 B1 * 11/2001 Girardot ..... A45D 40/26 15/104.93
D506,587 S * 6/2005 Armaly, Jr. ..... A47L 13/16 D28/63
D535,782 S * 1/2007 Caceres ..... D32/40
7,210,188 B1 * 5/2007 Kirby ..... A47L 13/16 15/244.4
7,284,293 B1 * 10/2007 Holder ..... B08B 1/00 15/210.1
D578,718 S * 10/2008 Bettanin ..... D32/40
7,454,813 B2 * 11/2008 Kaltenegger ..... A47L 25/00 15/210.1
D589,665 S * 3/2009 Kwapis ..... D28/7
7,543,352 B2 * 6/2009 Schaaf ..... A47L 13/16 15/244.4
7,779,847 B2 * 8/2010 Castagno ..... A45D 40/26 132/200
D643,151 S * 8/2011 Limongi ..... D28/7
8,393,043 B2 * 3/2013 Limongi ..... A45D 33/36 132/320
D685,962 S * 7/2013 Timm ..... D32/40
8,529,149 B2 * 9/2013 Yun ..... A46B 5/0095 132/73
8,752,559 B1 * 6/2014 Tsai ..... A45D 24/22 132/109
8,753,617 B2 * 6/2014 Jager Lezer ..... A61Q 1/10 424/70.7
D709,246 S * 7/2014 Norgart ..... D28/63
8,832,899 B2 * 9/2014 Yang ..... B08B 1/12 D4/137
D742,497 S * 11/2015 D'Amico ..... D23/366
D742,590 S * 11/2015 Johnson ..... D28/7
D749,203 S * 2/2016 D'Amico ..... D23/366
9,289,046 B1 * 3/2016 Blackwell ..... A45D 29/001
D768,947 S * 10/2016 Mantelli ..... D32/40
9,526,392 B2 * 12/2016 Konkey ..... A47K 7/02
D813,481 S * 3/2018 Jack ..... D32/40
D814,727 S * 4/2018 Wehrlie ..... D32/40
9,968,175 B2 * 5/2018 Nesbitt ..... A46B 3/005
D822,926 S * 7/2018 Ishibashi ..... D32/40

(56) References Cited

U.S. PATENT DOCUMENTS 10,441,058 B2 * 10/2019 Silva ..... A47K 7/02
D880,094 S * 3/2020 Romer ..... D32/40
D899,726 S * 10/2020 Burger ..... D1/100
D914,310 S * 3/2021 Bedue ..... D32/40
D918,526 S * 5/2021 Cody ..... D1/100
D929,696 S * 9/2021 Burger ..... D1/100
11,246,820 B2 * 2/2022 Samain ..... A45D 37/00
D956,378 S * 6/2022 Matilsky ..... D32/40
11,375,803 B2 * 7/2022 Berhault ..... A46B 9/021
D965,987 S * 10/2022 Xu ..... D4/118
D970,104 S * 11/2022 Bianco ..... D28/7
D989,430 S * 6/2023 Matilsky ..... D32/40
D996,749 S * 8/2023 Tukiainen ..... D32/14
D999,467 S * 9/2023 Tukiainen ..... D32/14
11,771,199 B2 * 10/2023 Silva ..... B32B 7/022 132/320
D1,032,135 S * 6/2024 Becattini, Jr. ..... D32/40
D1,032,136 S * 6/2024 Becattini, Jr. ..... D32/40
D1,032,986 S * 6/2024 Becattini, Jr ..... D32/40
D1,048,626 S * 10/2024 Xie ..... D32/40
2001/0031168 A1 * 10/2001 Gueret ..... B65D 81/28 401/126
2002/0019450 A1 * 2/2002 Fukuzawa ..... C08J 9/40 521/84.1
2002/0048482 A1 * 4/2002 Gueret ..... A45D 34/045 401/126
2002/0172541 A1 * 11/2002 Gueret ..... A45D 40/265 401/126
2003/0056804 A1 * 3/2003 Tajima ..... A45D 33/006 132/320
2003/0094186 A1 * 5/2003 Klein ..... A47L 17/08 15/244.4
2004/0258457 A1 * 12/2004 Legendre ..... A45D 34/04 401/133
2005/0045201 A1 * 3/2005 Williams ..... A45D 34/04 132/320
2005/0066456 A1 * 3/2005 Gavney, Jr. ..... H05B 3/60 601/142
2005/0086754 A1 * 4/2005 Dalias ..... A47L 13/12 15/160
2005/0155172 A1 * 7/2005 Gavney, Jr. ..... A46B 9/04 15/167.1
2005/0241091 A1 * 11/2005 Foster ..... A46B 9/005 15/167.1
2006/0060295 A1 * 3/2006 Hsu ..... A45D 33/34 156/267
2007/0169789 A1 * 7/2007 Castagno ..... A45D 19/012 132/320
2007/0169790 A1 * 7/2007 Castagno ..... A46B 9/005 132/320
2007/0231051 A1 * 10/2007 Flores ..... A61P 31/02 401/132
2007/0246061 A1 * 10/2007 Hirai ..... A46B 15/0032 132/328
2008/0017209 A1 * 1/2008 Gueret ..... A45D 34/04 132/73
2008/0159804 A1 * 7/2008 Brown ..... A45D 33/025 401/41
2009/0178221 A1 * 7/2009 Tsaur ..... A46D 1/00 15/207.2
2009/0199868 A1 * 8/2009 Cybulski ..... A47L 13/022 15/229.11
2010/0240003 A1 * 9/2010 Fritze ..... A46B 9/005 433/80
2011/0168198 A1 * 7/2011 Polanish ..... A46B 1/00 132/73
2011/0308031 A1 * 12/2011 Hartstock ..... A46B 3/005 15/171
2012/0118312 A1 * 5/2012 Rajaiah ..... A46B 11/0003 401/196
2012/0125357 A1 * 5/2012 Forgione ..... A45D 19/018 132/270
2012/0298131 A1 * 11/2012 Polanish ..... A46B 1/00 132/320
2015/0110541 A1 * 4/2015 Uresti ..... A46B 9/021 132/218
2016/0095415 A1 * 4/2016 Nakajima ..... A46B 11/0006 401/118
2016/0128445 A1 * 5/2016 Lim ..... A45D 33/00 132/317
2016/0166045 A1 * 6/2016 Nesbitt ..... A45D 33/006 401/129
2018/0027941 A1 * 2/2018 Choi ..... A01N 25/08
2018/0338600 A1 * 11/2018 Dizes ..... B32B 7/02
2019/0021469 A1 * 1/2019 Nogueira ..... A45D 44/12
2020/0170395 A1 * 6/2020 Dixon ..... A45D 34/04
2021/0169200 A1 * 6/2021 Son ..... A45D 34/04
2021/0212449 A1 * 7/2021 Dai ..... A45D 34/046
2024/0090646 A1 * 3/2024 Shadduck ..... A45D 40/26
2024/0298781 A1 * 9/2024 Leonard ..... A45D 40/262

FOREIGN PATENT DOCUMENTS

EP 3 398 476 A1 11/2018
GB 444265 A * 3/1936 ..... A46B 9/02
WO 2016/076406 A1 5/2016

* cited by examiner

COSMETIC APPLICATOR WITH FLEXIBLE APPLICATOR TIP

CROSS REFERENCE TO RELATED APPLICATIONS

The present application is based on and claims priority to U.S. Provisional Application No. 63/071,758, filed Aug. 28, 2020, the disclosure of which is incorporated by reference herein in its entirety. The present application is also based on and claims priority to French Application No. FR 2010831, filed on Oct. 22, 2020, the disclosure of which is incorporated by reference herein in its entirety.

BACKGROUND

Field of the Invention

The application generally relates to an apparatus including a flexible applicator tip with resistance structures for providing increasing flex resistance as more force is applied.

SUMMARY

In an embodiment, the present disclosure relates to a cosmetic applicator tip, including a base; a primary surface extending from the base, the primary surface including a height, a thickness, and a width; at least one auxiliary wall extending from the base, each auxiliary wall of the at least one auxiliary wall including a height.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
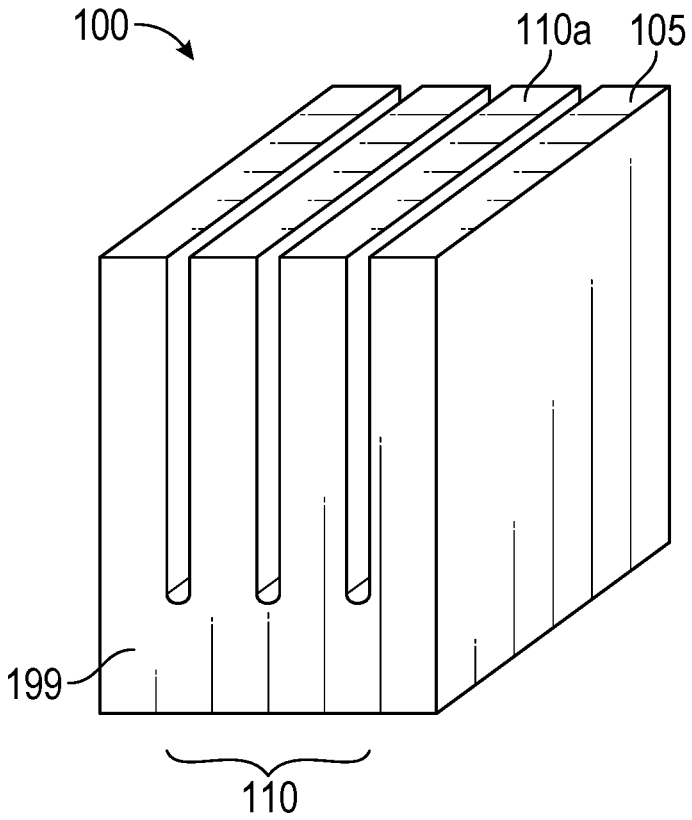
FIG. 1A shows a flexible applicator tip, according to an embodiment of the present disclosure.

A cosmetic applicator can be used to apply a cosmetic fluid onto a user's skin. Tactile feedback from the applicator can be limited due to the design of the vary parts of the applicator, such as the stem and tip. For example, a solid stem on an applicator can be limited in flexibility and tactile feedback based on the material used for the solid stem. The resulting flexibility, for example in the case of a polymer for the solid stem, follows the material properties of the polymer (e.g. Poisson ratio, toughness, etc.). Thus, an applicator including an applicator tip with a design to provide a wider range of tactile feedback via flexibility resisting supports can be desired. As described herein, a flexible applicator tip includes a primary application surface and at least one auxiliary flexibility resisting support wall.

The cosmetic applicator may be formed as a flexible applicator tip, wand, brush, or spatula and has a primary surface and one or more supporting "ribs" or auxiliary walls, preferably a plurality, arranged distally away from an applicator tip side or first side, that are adapted to contact a keratinous surface, such as skin and/or hair. The subject applicator may be utilized for a variety of cosmetic applications, including, for non-limiting example, use for lip gloss, mascara, eyebrow applications, liners, foundation applications, skin pads, and hair cosmetic applications and/or brushes.

As the applicator contacts the surface it flexes and/or compresses along a substantially linear pathway away from the contact surface, the primary surface and auxiliary wall and/or auxiliary walls are contacted individually as pressure increases, but they cumulatively contact each other, increasing the force that the applicator is applying on the skin. The applicator in effect is flexible, but gets stiffer as more force is applied, and the buttressing effect of the primary surface engaging with the auxiliary wall/s increases. The buttressed arrangement of the primary surface and auxiliary wall/s can be the same geometry and/or flex equally, but each of the primary surface and one or more auxiliary walls are preferably different shapes, heights and/or thicknesses, to more quickly or slowly increase in stiffness or resistance. The subject cosmetic applicator provides a buttressed system on the distal side of the contact with the skin, face, hair or body. Preferably, the primary surface and auxiliary wall/s are arrayed linearly (buttresses to bend like a line of dominoes when the first surface is pushed), or symmetrically (an applicator tip that is imbedded in concentric rings that function as buttresses from any direction towards the applicator axis).

By creating a staggered buttress system, the cosmetic applicator has the ability to add force feedback to an application system, whereby, the harder a user pushes, the stiffer the resistance of the applicator as a gradient increase. It also provides a spring-like response as the applicator is compressed against the buttressed structure. As a result, the applicator is composed of certain soft or low durometer cosmetic materials so as to exhibit signature properties when lightly touched, but becoming more rigid as they are compressed against the buttressed area(s). Conversely, the subject applicator causes certain harder materials that have excellent chemical or mechanical features to "soften" as the primary surface and auxiliary walls flex towards the buttressed areas, and then stiffen again as compressed.

The subject cosmetic applicator is preferably composed of a polymeric material, including elastomeric materials, silicones, thermoplastic elastomers, or thermoplastic polyurethane, an olefin such as polypropylene or polyethylene, and/or conventional flexible plastics (thermosets and thermoplastics) preferably having a thickness ranging from about 0.25 to 2 mm in order to bend or flex enough for the buttressing force action. The applicator may be made of one material or a combination of molded materials, including by way of bi-injected or insert over-molded material applications. Materials in additive manufacturing can be used for this as well as shape-memory polymers and alloys.

FIG. 1A shows a flexible applicator tip 100, according to an embodiment of the present disclosure. In an embodiment, the flexible applicator tip 100 includes a base 199, a primary surface 105, and at least one auxiliary flexibility resisting support wall 110 (hereinafter referred to as "at least one auxiliary wall 110"). The at least one auxiliary wall 110 can include a first auxiliary wall 110*a*. The primary surface 105 and the first auxiliary wall 110*a* extend upwards from (or in a direction away from) the base 199. The primary surface 105 includes a height, a thickness, and a width. Similarly, the at least one auxiliary wall 110 includes a height, a thickness, and a width. The base 199 can be attached to a mount (not shown) having a coupling feature and coupled to an applicator stem. The base 199 can also be directly attached to the applicator stem.

As shown, the primary surface 105 is disposed on a first side of the base 199, such as the right side, and the at least one auxiliary wall 110 is disposed adjacent to the primary surface 105 opposite first side of the base 199. That is, the first auxiliary wall 110*a* is disposed on a first side of the primary surface 105 opposite the first side of the base 199, such as to the left of the primary surface 105. The primary surface 105 and the at least one auxiliary wall 110 can be relatively uniform with each other, each having the height, thickness, and width that is the same, thereby creating a flat, parallel, lamellar design. A gap is disposed between each of the primary surface 105 and the at least one auxiliary wall 110. The gap can hold cosmetic fluid and slowly release the cosmetic fluid as the user applies the cosmetic fluid to their skin. The user applies the cosmetic fluid to their skin using, primarily, the primary surface 105. The primary surface 105 and the at least one auxiliary wall 110 is formed of a flexible material, such as a flexible polymer, elastomer, silicone, thermoplastic elastomers, polyurethane, olefins, polypropylene, polyethylene, and/or conventional flexible plastics, and/or combinations thereof.

Figure 1B:
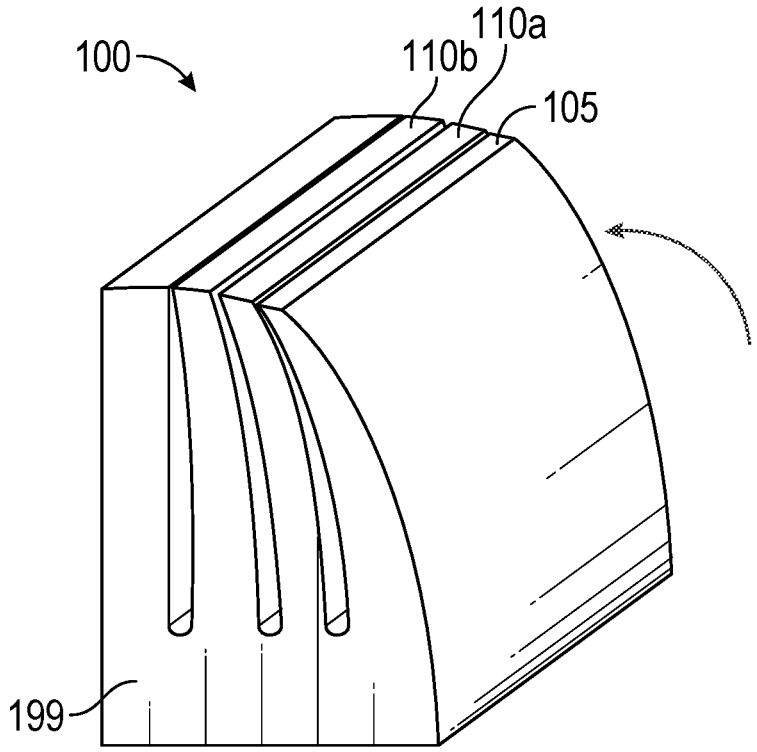
FIG. 1B shows a flexible applicator tip under flexion, according to an embodiment of the present disclosure.

FIG. 1B shows the flexible applicator tip 100 under flexion, according to an embodiment of the present disclosure. In an embodiment, the user presses the primary surface 105 onto their skin such that the primary surface 105 deflects towards the first auxiliary wall 110*a*. At first, a small resistance to the flexing of the primary surface 105 is felt due to the inherent elasticity of the polymer material as the primary surface 105 flexes into an area of the gap. Upon contacting the first auxiliary wall 110*a*, the first auxiliary wall 110*a* increases the resistance to the flex of the primary surface 105. That is, the user feels a tactile feedback amounting to the aggregate resistance in flex attributed to both the primary surface 105 and the first auxiliary wall 110*a*. Similarly, a second auxiliary wall 110*b* can be disposed on the base 199 on a first side of the first auxiliary wall 110*a* opposite the primary surface 105. Upon additional force from the user, the primary surface 105 as well as the first auxiliary wall 110*a* deflects across the gap separating the first auxiliary wall 110*a* and the second auxiliary wall 110*b* and the first auxiliary wall 110*a* (having the primary surface 105 pressed thereon) contacts the second auxiliary wall 110*b*. Similarly, the second auxiliary wall 110*b* provides an addition source of flex resistance. By this point, the amount of flex on the primary surface 105 is much higher than the amount of flex on the second auxiliary wall 110*b*, and the primary surface 105 can attribute proportionally higher flex resistance. Furthermore, additional at least one auxiliary wall 110 can be disposed on the base 199 to provide more flex resistance. In effect, by including the at least one auxiliary wall 110, a flex resistance gradient is established along the cosmetic fluid application direction.

FIG. 2A-2E shows a flexible applicator tip 200, according to an embodiment of the present disclosure. In an embodiment, the flexible applicator tip 200 includes a base 299, a primary surface 205, and at least one auxiliary flexibility resisting support wall 210 (hereinafter referred to as "at least one auxiliary wall 210"). The at least one auxiliary wall 210 can include a first auxiliary wall 210*a*. The primary surface 205 and the first auxiliary wall 210*a* extend upwards from (or in a direction away from) the base 299. The primary surface 205 includes a height, a thickness, and a width. Similarly, the at least one auxiliary wall 210 includes a height, a thickness, and a width. The base 299 can be attached to a mount having a tail 220 and inserted into an applicator stem having a corresponding receiving feature. The base 299 can also be directly attached to the applicator stem.

As shown, the primary surface 205 is disposed in a center of the base 299 and the first auxiliary wall 210*a* the at least one auxiliary wall 210 is disposed adjacent to the primary surface 205 on a first side of the primary surface 205, such as the left side, and parallel to the primary surface 205. A second auxiliary wall 210*b* of the at least one auxiliary wall 210 is disposed adjacent to the primary surface 205 on a second side of the primary surface 205, such as the right side, and parallel to the primary surface 205. Additional auxiliary walls of the at least one auxiliary wall 210 can be added. The primary surface 205, the first auxiliary wall 210*a*, and the second auxiliary wall 210*b* are planar in shape. Notably, as compared to the embodiment of FIGS. 1A and 1B, the height of the first auxiliary wall 210*a* and the second auxiliary wall 210*b* is less than the height of the primary surface 205. Furthermore, the planar shape of the primary surface 205, the first auxiliary wall 210*a*, and the second auxiliary wall 210*b* tapers to a point at an end of the plane extending away from the base 299. A gap is disposed between each of the primary surface 205 and the at least one auxiliary wall 210, wherein the gap can hold the cosmetic fluid and slowly release the cosmetic fluid as the user applies the cosmetic fluid to their skin.

Figure 2A:
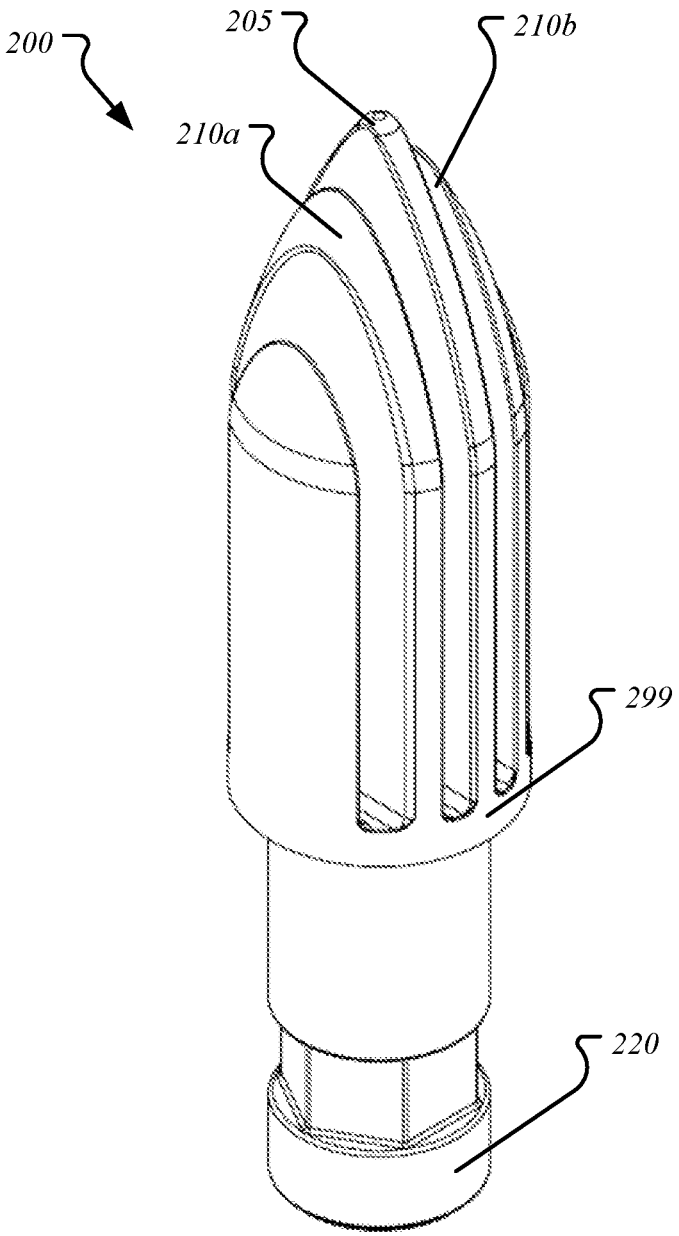
FIG. 2A-2E shows a flexible applicator tip, according to an embodiment of the present disclosure.
Figure 2B:
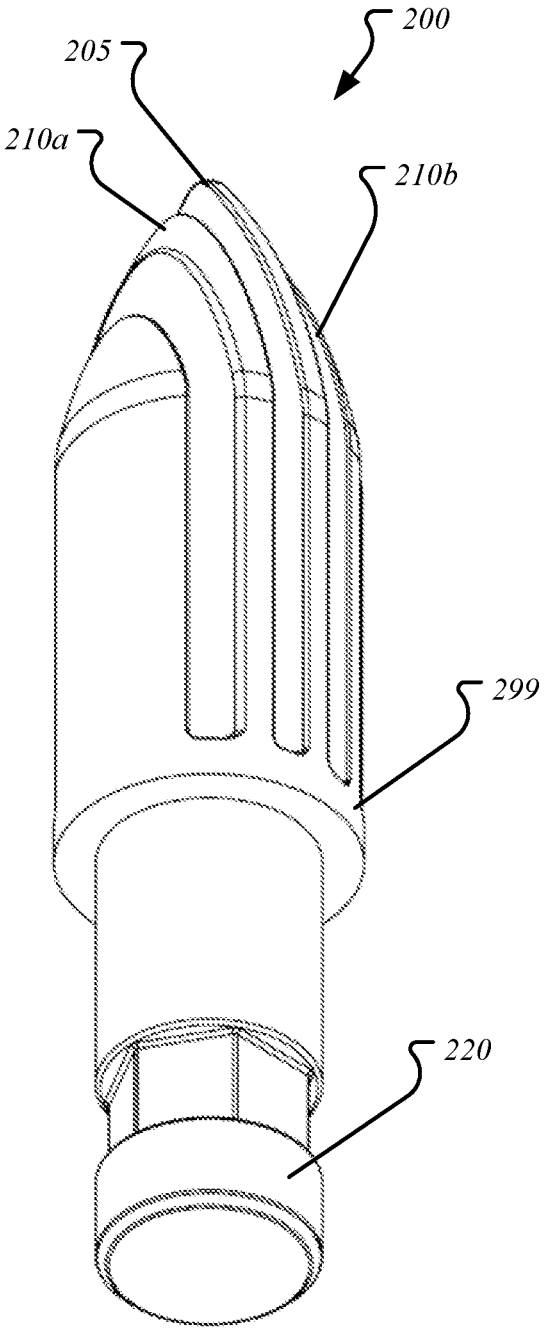
Figure 2C:
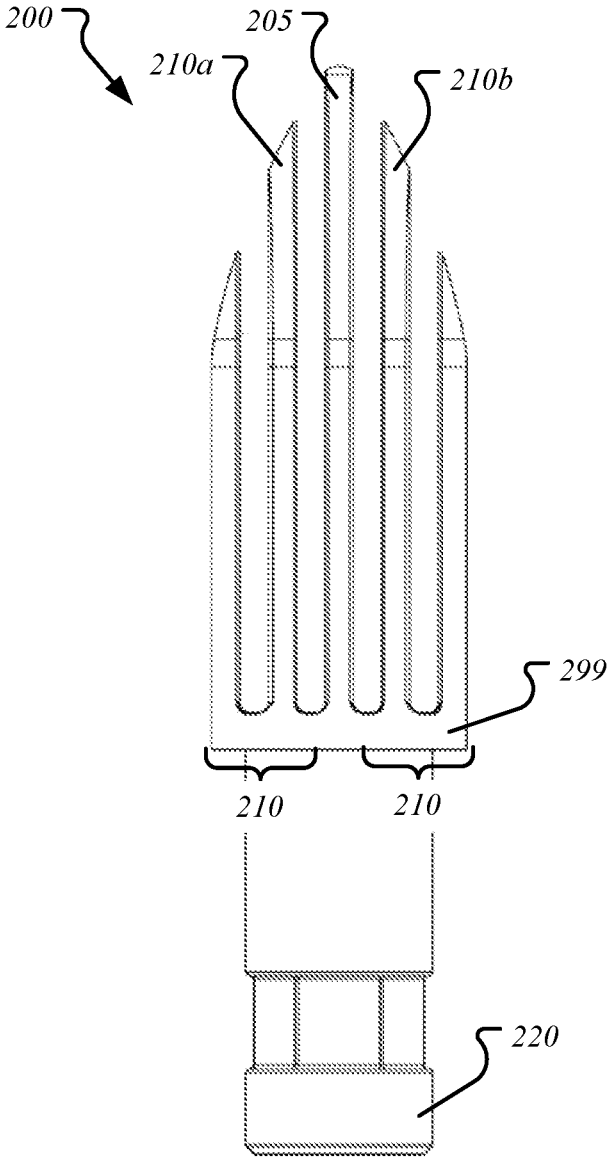
Figure 2D:
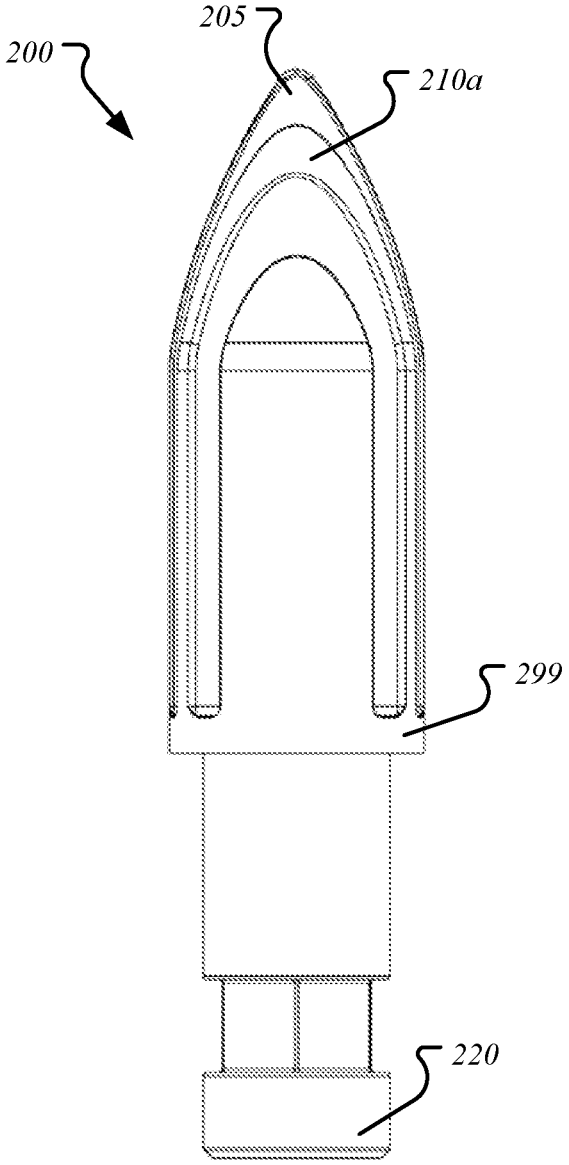
Figure 2E:
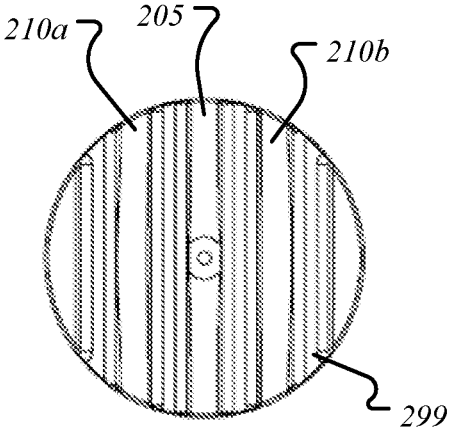

FIG. 2C highlights the heights of the primary surface 205, the first auxiliary wall 210*a*, and the second auxiliary wall 210*b*. In the same embodiment, this allows the user to apply the cosmetic fluid in additional ranges of motion. For example, the user can apply the cosmetic fluid using the primary surface 205 with a first stroke from the first side of the primary surface 205 such that the first auxiliary wall 210*a* is first deflected into the primary surface 205 and the primary surface 205 is secondly deflected into the second auxiliary wall 210*b*, followed by reversing direction with a second stroke such that the second auxiliary wall 210*b* is first deflected into the primary surface 205 and the primary surface 205 is secondly deflected into the first auxiliary wall 210*a*. The primary surface 205 includes inherent flexibility resistance based on the polymer material as the deflection increases, while the first auxiliary wall 210*a* and the second auxiliary wall 210*b* provide additional flex resistance as the primary surface 205 is deflected towards either direction.

Figure 3:
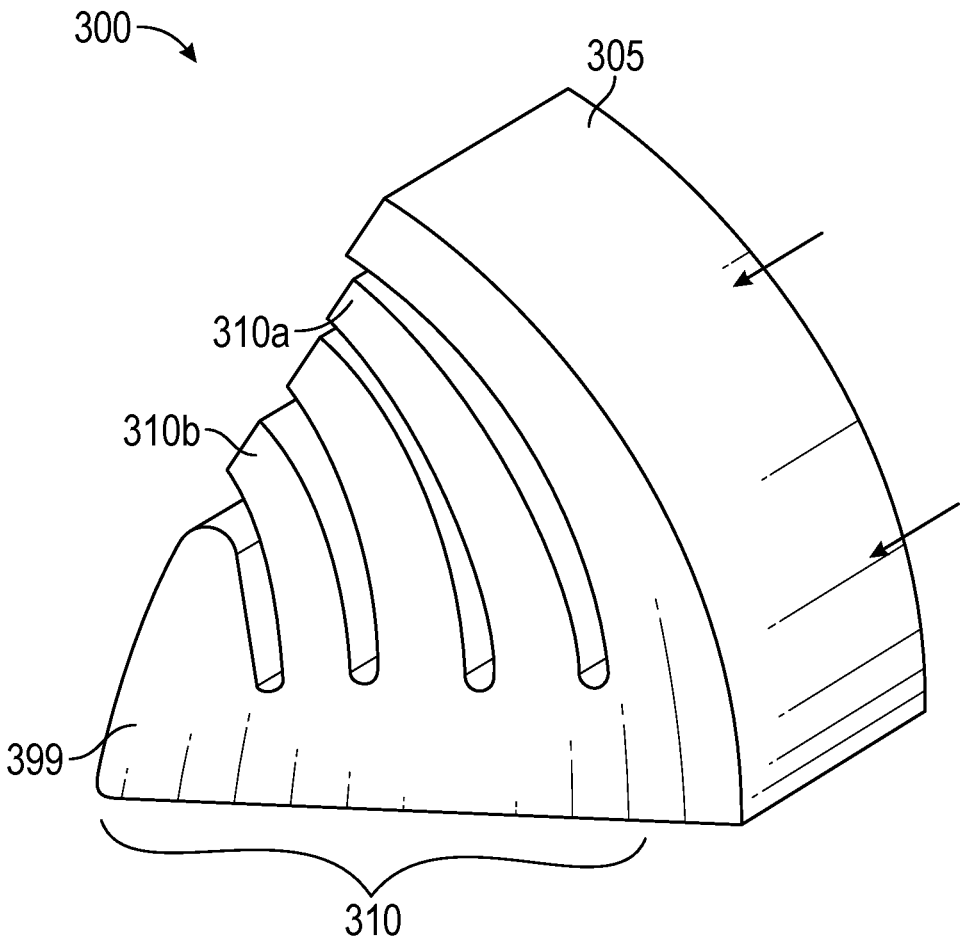
FIG. 3 shows a flexible applicator tip, according to an embodiment of the present disclosure.

FIG. 3 shows a flexible applicator tip 300, according to an embodiment of the present disclosure. In an embodiment, the flexible applicator tip 300 includes a base 399, a primary surface 305, and at least one auxiliary flexibility resisting support wall 310 (hereinafter referred to as "at least one auxiliary wall 310"). The at least one auxiliary wall 310 can include a first auxiliary wall 310*a*. The primary surface 305 and the first auxiliary wall 310*a* extend upwards from (or in a direction away from) the base 399. The primary surface 305 includes a height, a thickness, and a width. Similarly, the at least one auxiliary wall 310 includes a height, a thickness, and a width. The base 399 can be attached to a mount (not shown) having a coupling feature and coupled to an applicator stem. The base 399 can also be directly attached to the applicator stem.

As shown, the primary surface 305 is disposed on a first side of the base 399, such as the right side, and the at least one auxiliary wall 310 is disposed adjacent to the primary surface 305 opposite first side of the base 399. That is, a first auxiliary wall 310*a* of the at least one auxiliary wall 310 is disposed on a first side of the primary surface 305 opposite the first side of the base 399, such as to the left of the primary surface 305. The primary surface 305 and the at least one auxiliary wall 310 can be relatively uniform with each other, each having the thickness and width that is the same with the height decreasing moving away from the first side of the base (or to the left, as shown), thereby creating an inclined, parallel, lamellar design. A gap is disposed between each of the primary surface 305 and the at least one auxiliary wall 310. The gap can hold cosmetic fluid and slowly release the cosmetic fluid as the user applies the cosmetic fluid to their skin. The user applies the cosmetic fluid to their skin using, primarily, the primary surface 305 along the first side of the base 399.

In FIG. 3, the applicator tip 300 is under flexion. In the same embodiment, the user presses the primary surface 305 onto their skin such that the primary surface 305 deflects towards the first auxiliary wall 310*a*. At first, a small resistance to the flexing of the primary surface 305 is felt due to the inherent elasticity of the polymer material as the primary surface 305 flexes into an area of the gap. Upon contacting the first auxiliary wall 310*a*, the first auxiliary wall 310*a* increases the resistance to the flex of the primary surface 305. That is, the user feels a tactile feedback amounting to the aggregate resistance in flex attributed to both the primary surface 305 and the first auxiliary wall 310*a*. As compared to the embodiment of FIG. 1B, the shorter height of the first auxiliary wall 310*a* provides less flex resistance than the first auxiliary wall 110*a*. However, the shorter height of the first auxiliary wall 310*a* also allows the taller primary surface 305 act as a more fine application surface without accidental smudging or cosmetic fluid contribution from the first auxiliary wall 310*a*.

Similarly, a second auxiliary wall 310*b* can be disposed on the base 399 on a first side of the first auxiliary wall 310*a* opposite the primary surface 305. Upon additional force from the user, the primary surface 305 as well as the first auxiliary wall 310*a* deflects across the gap separating the first auxiliary wall 310*a* and the second auxiliary wall 310*b* and the first auxiliary wall 310*a* (having the primary surface 305 pressed thereon) contacts the second auxiliary wall 310*b*. The second auxiliary wall 310*b* provides an addition source of flex resistance, but provides less flex resistance as compared to the taller first auxiliary wall 310*a*. Additional at least one auxiliary wall 310 can be disposed on the base 399 to provide more flex resistance. In effect, by including the at least one auxiliary wall 310, a flex resistance gradient is established along the cosmetic fluid application direction, the flex resistance contribution being less and less as additional, shorter at least one auxiliary wall 310 is added.

Notably, for the embodiment of FIG. 3 (and FIGS. 4 and 5, to be described), the user can decide that they want to use just the primary surface 305 without the force resistance gradient contribution from the at least one auxiliary wall 310. In such a case, the primary surface 305 having the taller height can be contacted and brushed in a direction away from the at least one auxiliary wall 310, such as to the right in relation to FIG. 3. For the primary surface 305 having sufficient height, the user's skin will contact and deflect only the primary surface 305. For the least flex resistance, this direction can be used to apply the cosmetic fluid with the lightest force applied on the skin, such as for eyeliner (e.g. applying a tapered or "winged" liner towards the outer edge of the eye).

Figure 4A:
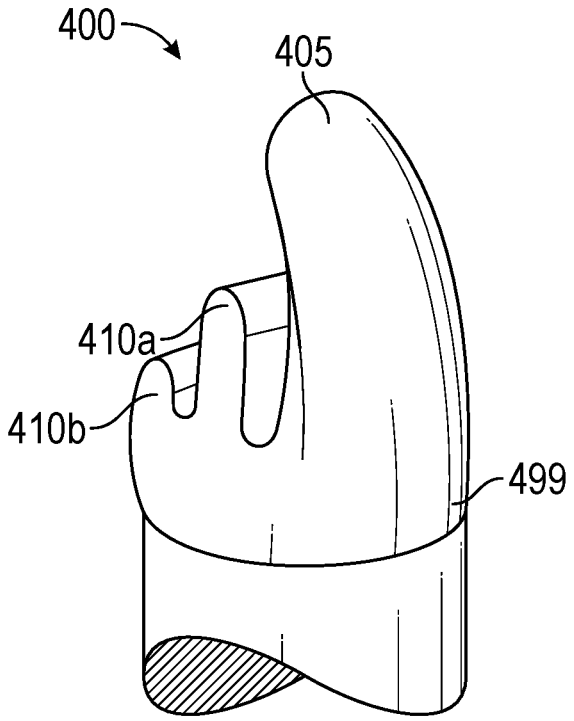
FIG. 4A shows a flexible applicator tip, according to an embodiment of the present disclosure.

FIG. 4A shows a flexible applicator tip 400, according to an embodiment of the present disclosure. In an embodiment, the flexible applicator tip 400 includes a base 499, a primary surface 405, and at least one auxiliary flexibility resisting support wall 410 (hereinafter referred to as "at least one auxiliary wall 410"). The at least one auxiliary wall 410 can include a first auxiliary wall 410*a*. The primary surface 405 and the first auxiliary wall 410*a* extend upwards from (or in a direction away from) the base 499. The primary surface 405 can be cylindrical in shape and the at least one auxiliary wall 410 can be planar in shape. It may be appreciated that the at least one auxiliary wall 410 need not be planar in shape, but can adopt other shapes including curved, chevron, and zig-zag to resist the deflection of the primary surface 405 or aid in retaining cosmetic fluid. It may be appreciated that the primary surface need not be perfectly cylindrical in shape, but a cross-section of the primary surface 405 can be elliptical in shape as well. Additionally, the primary surface 405 need not be erect and linear, but can also include a slight curve such that an end of the primary surface 405 curls inwards towards the center of the base 499 or outwards away from the center of the base 499. The primary surface 405 includes a height and a diameter (or a major diameter and a minor diameter, in the case of an ellipse). The at least one auxiliary wall 410 includes a height, a thickness, and a width. The base 499 can be attached to a mount (not shown) having a coupling feature and coupled to an applicator stem. The base 499 can also be directly attached to the applicator stem.

As shown, the primary surface 405 is disposed on a first side of the base 499, such as the right side, and the at least one auxiliary wall 410 is disposed adjacent to the primary surface 405 opposite first side of the base 499. That is, the first auxiliary wall 410*a* of the at least one auxiliary wall 410 is disposed on a first side of the primary surface 405 opposite the first side of the base 499, such as to the left of the primary surface 405. A gap is disposed between each of the primary surface 405 and the at least one auxiliary wall 410. The gap can hold cosmetic fluid and slowly release the cosmetic fluid as the user applies the cosmetic fluid to their skin. The user applies the cosmetic fluid to their skin using, primarily, the primary surface 405 along the first side of the base 499.

Figure 4B:
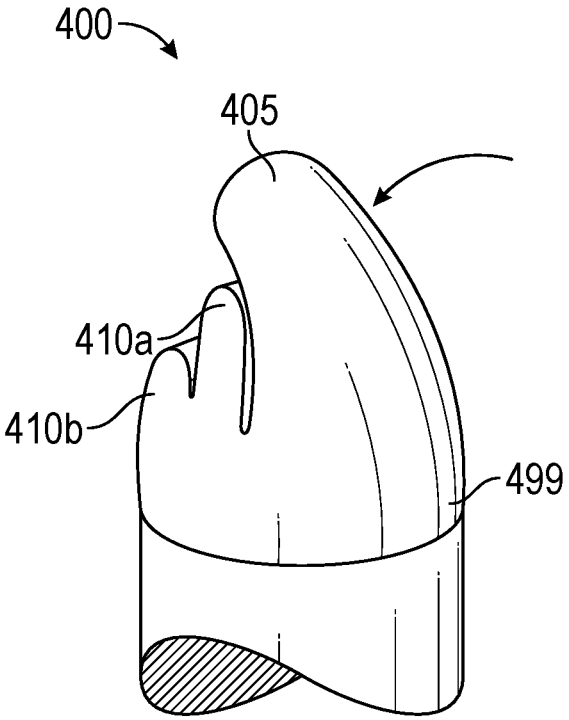
FIG. 4B shows a flexible applicator tip under flexion, according to an embodiment of the present disclosure.

FIG. 4B shows the flexible applicator tip 400 under flexion, according to an embodiment of the present disclosure. In an embodiment, the user presses the primary surface 405 onto their skin such that the primary surface 405 deflects towards the first auxiliary wall 410*a*. The curvature of the primary surface 405 helps the user draw a finer line as compared to, for example, the planar shape of the primary surface 105 of FIG. 1B. The user also alters the line thickness instantaneously by adjusting the pressure applied.

At first, a small resistance to the flexing of the primary surface 405 is felt due to the inherent elasticity of the polymer material as the primary surface 405 flexes into an area of the gap. Upon contacting the first auxiliary wall 410*a*, the first auxiliary wall 410*a* increases the resistance to the flex of the primary surface 405. That is, the user feels a tactile feedback amounting to the aggregate resistance in flex attributed to both the primary surface 405 and the first auxiliary wall 410*a*. Similarly, a second auxiliary wall 410*b* can be disposed on the base 499 on a first side of the first auxiliary wall 410*a* opposite the primary surface 405. Upon additional force from the user, the primary surface 405 as well as the first auxiliary wall 410*a* deflects across the gap separating the first auxiliary wall 410*a* and the second auxiliary wall 410*b* and the first auxiliary wall 410*a* (having the primary surface 405 pressed thereon) contacts the second auxiliary wall 410*b*. Similarly, the second auxiliary wall 410*b* provides an addition source of flex resistance. By this point, the amount of flex on the primary surface 405 is much higher than the amount of flex on the second auxiliary wall 410*b*, and the primary surface 405 can attribute proportionally higher flex resistance. Furthermore, additional at least one auxiliary wall 410 can be disposed on the base 499 to provide more flex resistance. In effect, by including the at least one auxiliary wall 410, a flex resistance gradient is established along the cosmetic fluid application direction.

As shown, the height of the first auxiliary wall 410*a* is shorter than the primary surface 405, and the height of the second auxiliary wall 410*b* is shorter than the first auxiliary wall 410*a*, but it may be appreciated the height of the first auxiliary wall 410*a* and the second auxiliary wall 410*b* can be the same.

Figure 5A:
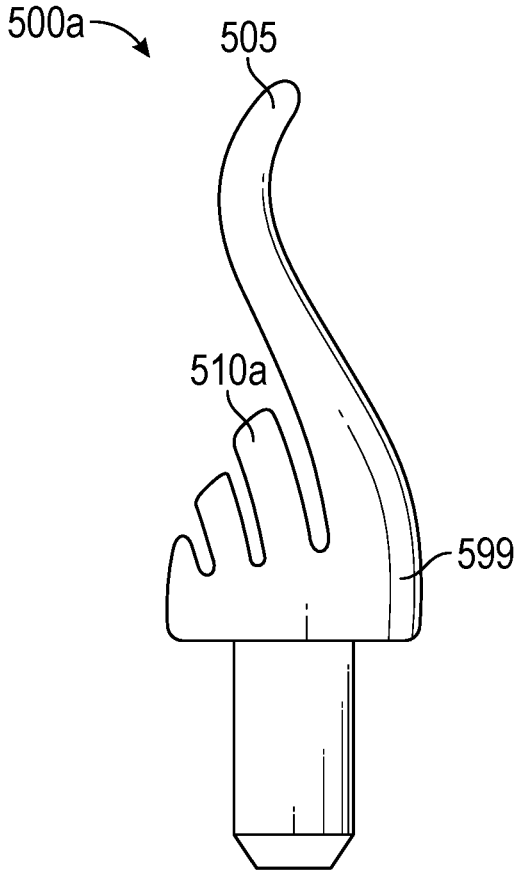
FIG. 5A shows a flexible applicator tip with an open auxiliary wall support system, according to an embodiment of the present disclosure.

FIG. 5A shows a flexible applicator tip 500*a* with an open auxiliary wall support system, according to an embodiment of the present disclosure. In an embodiment similar to that of FIGS. 4A and 4B, the flexible applicator tip 500*a* includes a base 599, a primary surface 505, and at least one auxiliary flexibility resisting support wall 510 (hereinafter referred to as "at least one auxiliary wall 510"), the at least one auxiliary wall 510 including a first auxiliary wall 510*a*. The primary surface 505 can be cylindrical in shape, with a cross-section of the primary surface 505 being circular or elliptical. Here, the primary surface 505 includes curvature both inwards towards the center of the base 599 along a base of the primary surface 505 and outwards away from the center of the base 599 towards an end of the primary surface 505, and the primary surface 505 terminates with a fine point at the end. The curvature towards the end of the primary surface 505 can be used to more closely follow the contour of a feature on the user's face, such as the user's lips. The fine point at the end of the primary surface can aid in applying thin lines of the cosmetic fluid. The primary surface 505 includes a height and a diameter (or a major diameter and a minor diameter, in the case of an ellipse). The at least one auxiliary wall 510 includes a height, a thickness, and a width. The base 599 can be attached to a mount (not shown) having a coupling feature and coupled to an applicator stem. The base 599 can also be directly attached to the applicator stem.

As shown, the primary surface 505 is disposed on a first side of the base 599, such as the right side, and the at least one auxiliary wall 510 is disposed adjacent to the primary surface 505 opposite first side of the base 599. That is, the first auxiliary wall 510*a* of the at least one auxiliary wall 510 is disposed on a first side of the primary surface 505 opposite the first side of the base 599, such as to the left of the primary surface 505. A gap is disposed between each of the primary surface 505 and the at least one auxiliary wall 510. The gap can hold cosmetic fluid and slowly release the cosmetic fluid as the user applies the cosmetic fluid to their skin. The user applies the cosmetic fluid to their skin using, primarily, the primary surface 505 along the first side of the base 599.

In the same embodiment, the height of the primary surface 505 is significantly taller than the height of the first auxiliary surface 510*a*. As such, upon application of the cosmetic fluid using the fine point of the primary surface 505, the base of the primary surface 505 can deflect and abut the first auxiliary surface 510*a*, thereby providing resistance to the flex of the primary surface 505 via the first auxiliary surface 510*a*. However, since the height of the primary surface 505 is much taller, the leverage from the taller height imparts less tactile feedback to the user (i.e. the user feels less resistance). Furthermore, the primary surface 505 can include an inflection point where the curvature of the primary surface 505 changes from convex to concave (relative to a view from the first side of the base 599). Sufficient force applied from the user can cause the primary surface 505 to deflect towards the center of the base 599 until all of the at least one auxiliary walls 110 are pressed against the deflected primary surface 505. At this point, the user can continue to apply force and only the end of the primary surface 505 may continue to deflect while the base of the primary surface 505 is mostly compressed and stable. This can allow further elongation of the tip of the primary surface 505 if the user desires.

Figure 5B:
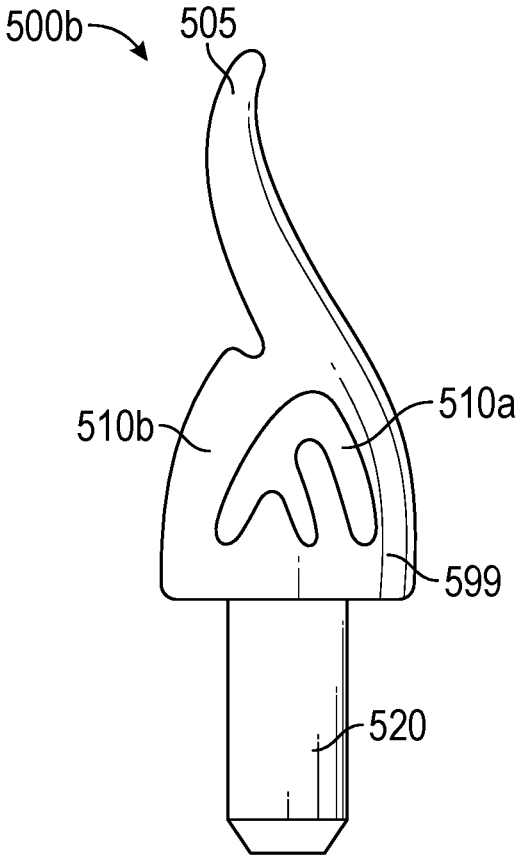
FIG. 5B shows a flexible applicator tip with a closed auxiliary wall support system, according to an embodiment of the present disclosure.

FIG. 5B shows a flexible applicator tip 500*b* with a closed auxiliary wall support system, according to an embodiment of the present disclosure. In an embodiment similar to that of FIG. 5A, the flexible applicator tip 500*b* includes the base 599, the primary surface 505, and the at least one auxiliary flexibility resisting support wall 510, the at least one auxiliary wall 510 including the first auxiliary wall 510*a*. The primary surface 505 can be cylindrical in shape, with a cross-section of the primary surface 505 being circular or elliptical. The primary surface 505 includes curvature both inwards towards the center of the base 599 along a base of the primary surface 505 and outwards away from the center of the base 599 towards an end of the primary surface 505, and the primary surface 505 terminates with a fine point at the end. Here, the at least one auxiliary wall 510 also includes a second auxiliary wall 510*b* disposed on a first side of the first auxiliary wall 510*a* opposite the first side of the base 599, wherein the second auxiliary wall 510*b* is attached to the primary surface 505. The second auxiliary wall 510*b* forms a hollow cavity defined by the primary surface 505, the base 599, and the second auxiliary wall 510*b*. Disposed in an interior of the hollow cavity is the first auxiliary wall 510*a*. In this embodiment, additional resistance from the attachment of the second auxiliary wall 510*b* to the primary surface 505 prevents undesired bending of the end of the primary surface 505. The first auxiliary wall 510*a* can still apply additional flex resistance upon sufficient deflection of the primary surface 505 across the gap between the first auxiliary wall 510*a* and the primary surface 505 to abut the primary surface 505 against the first auxiliary wall 510*a*. The second auxiliary wall 510*b* can include a notch at the attachment point to the primary surface 505 in order to influence the second auxiliary wall 510*b* to bend in a predetermined direction. Notably, the closed auxiliary wall support system can help prevent retention and build-up of the cosmetic fluid between each of the at least one auxiliary wall 510. It may be appreciated that the closed auxiliary wall support system can be applied to previous embodiments as well.

Figure 6A:
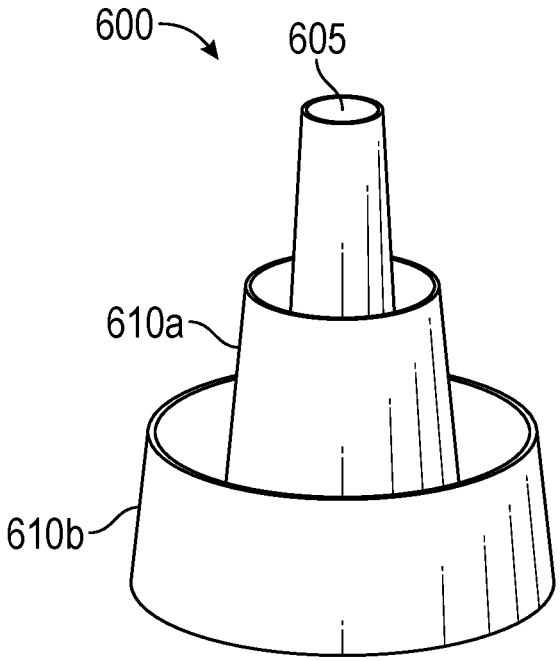
FIG. 6A shows a flexible applicator tip, according to an embodiment of the present disclosure.

FIG. 6A shows a flexible applicator tip 600, according to an embodiment of the present disclosure. In an embodiment, the flexible applicator tip 600 includes a base (not shown), a primary surface 605, and at least one auxiliary flexibility resisting support wall 610 (hereinafter referred to as "at least one auxiliary wall 610"), the at least one auxiliary wall 610 including a first auxiliary wall 610*a*. The primary surface 605 can be cylindrical in shape, with a cross-section of the primary surface 605 being circular or elliptical. The primary surface 605 includes a height and a diameter (or a major diameter and a minor diameter, in the case of an ellipse). The at least one auxiliary wall 610 includes a height, a thickness, and a width. The base can be attached to a mount (not shown) having a coupling feature and coupled to an applicator stem. The base can also be directly attached to the applicator stem.

As shown, the primary surface 605 is disposed in a center of the base, and the first auxiliary wall 610*a* is disposed concentrically around the primary surface 605. A second auxiliary wall 610*b* can also be disposed concentrically around the first auxiliary wall 610*a*. A gap is disposed between each of the primary surface 605 and the at least one auxiliary wall 610. The gap can hold cosmetic fluid and slowly release the cosmetic fluid as the user applies the cosmetic fluid to their skin. The user applies the cosmetic fluid to their skin using, primarily, the primary surface 605. Here, since the design of the flexible applicator tip 600 is symmetrical in all directions around the axis parallel to the extension direction, the user can apply the cosmetic fluid via brushing in any direction and the user will feel the same tactile feedback.

Figure 6B:
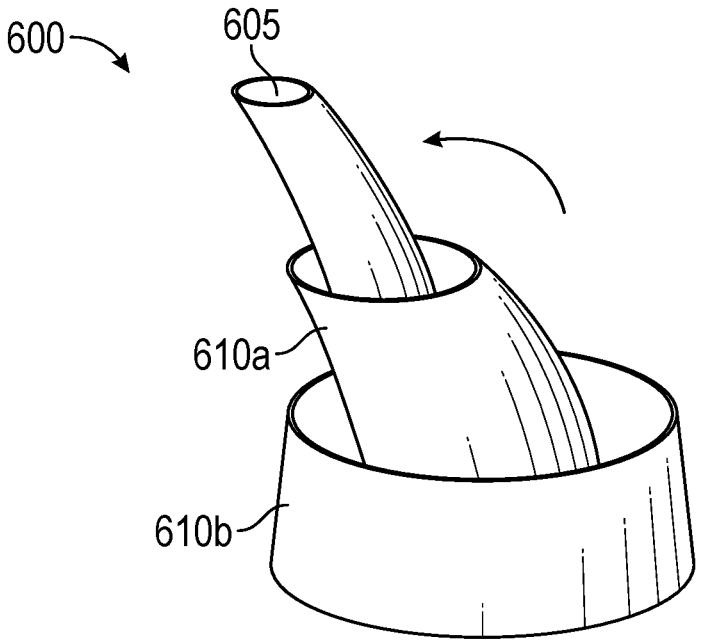
FIG. 6B shows flexion of a flexible applicator tip, according to an embodiment of the present disclosure.

FIG. 6B shows flexion of the flexible applicator tip 600, according to an embodiment of the present disclosure. In the same embodiment, this allows the user to apply the cosmetic fluid in any direction of motion. The user can apply the cosmetic fluid and the primary surface 605 will always be deflected into the first auxiliary wall 610*a*. Additional application force will result in the first auxiliary wall 610*a* being deflected into the second auxiliary wall 610*b*. As previously described, the primary surface 605 includes inherent flexibility resistance based on the polymer material as the deflection increases, while the first auxiliary wall 610*a* and the second auxiliary wall 610*b* provide additional flex resistance as the primary surface 605 is deflected in any direction.

The description above in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one aspect", "one embodiment", "an aspect", or "an embodiment" means that a particular feature, structure, characteristic, operation, or function described in connection with an embodiment is included in at least one embodiment of the disclosed subject matter. Thus, any appearance of the phrases "one aspect", "one embodiment", "an aspect", or "an embodiment" in the specification is not necessarily referring to the same aspect or embodiment. Further, the particular features, structures, characteristics, operations, or functions may be combined in any suitable manner in one or more aspects or embodiments. Further, it is intended that aspects or embodiments of the disclosed subject matter can and do cover modifications and variations of the described aspects or embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear," "side," "interior," "exterior," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

A number of embodiments have been described. Nevertheless, it will be understood that various modifications are made without departing from the spirit and scope of this disclosure. For example, preferable results are achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. A cosmetic applicator tip, comprising:

the applicator tip is defined by a volume including a height dimension, a width dimension, and a thickness dimension;

a base extends partly in the height dimension and fully in the width dimension and the thickness dimension, the base is solid in the width dimension and the thickness dimension throughout the height dimension of the base;

only four or five walls extending from the base, each wall extending fully in the thickness dimension and the height dimension and partly in the width dimension of the volume, wherein each wall has a height dimension at least twice the height dimension of the base, wherein a material of each wall is silicone, each of the walls includes a first surface and an opposite second surface, a width of each of the walls is defined from the first surface to the second surface of each wall, wherein the width of each of the walls is from 0.25 mm to 2 mm, the first and second surfaces of all of the walls are parallel, a gap between any two adjacent walls, wherein each gap holds cosmetic fluid to slowly release the cosmetic fluid, each gap extends from the base fully in the thickness dimension and partly in the width dimension of the volume, wherein under flexion, the height dimension of the walls is sufficient to allow adjacent walls to deflect across the gap so that resistance to flexing of the applicator tip is increased proportional to a number of the adjacent walls that make contact with each other, wherein the cosmetic fluid is one of gloss, mascara, eyebrow applications, liners, and foundation applications.

2. The cosmetic applicator tip of claim 1, wherein the height of the base is uniform along the width dimension and the thickness dimension.

3. The cosmetic applicator tip of claim 1, wherein the width of each wall is uniform in the height dimension.

4. The cosmetic applicator tip of claim 1, wherein the width of all walls is the same.

5. The cosmetic applicator tip of claim 1, wherein the volume is a cuboid.

6. A cosmetic applicator tip, comprising:

the applicator tip is defined by a cuboid including a height dimension, a width dimension, and a thickness dimension;

a base extends partly in the height dimension and fully in the width dimension and the thickness dimension, the base is solid in the width dimension and the thickness dimension throughout the height dimension of the base;

only four or five walls extending from the base, each wall extending fully in the thickness dimension and the height dimension and partly in the width dimension of the cuboid, wherein each wall has a height dimension at least twice the height dimension of the base, wherein a material of each wall is silicone, the height dimension of each wall terminates at the height dimension of the cuboid, each of the walls includes a first surface and an opposite second surface, a width of each of the walls is defined from the first to the second surface of each wall, wherein the width of each of the walls is from 0.25 mm to 2 mm, the first and second surfaces of all of the walls are parallel, and a gap between any two adjacent walls, wherein each gap holds cosmetic fluid to slowly release the cosmetic fluid, each gap extends from the base fully in the thickness dimension and partly in the width dimension of the volume, wherein under flexion, the height dimension of the walls is sufficient to allow adjacent walls to deflect across the gap so that resistance to flexing of the applicator tip is increased proportional to a number of the adjacent walls that make contact with each other, wherein the cosmetic fluid is one of gloss, mascara, eyebrow applications, liners, and foundation applications.

* * * * *